US008269682B2

(12) United States Patent
Su

(10) Patent No.: US 8,269,682 B2
(45) Date of Patent: Sep. 18, 2012

(54) MULTI-LOOP ANTENNA MODULE WITH WIDE BEAMWIDTH

(75) Inventor: Saou-Wen Su, Keelung (TW)

(73) Assignees: Silitek Electronic (Guangzhou) Co., Ltd., Guangzhou (CN); Lite-On Technology Corporation, Taipei (TW)

( * ) Notice: Subject to any disclaimer, the term of this patent is extended or adjusted under 35 U.S.C. 154(b) by 299 days.

(21) Appl. No.: 12/786,867

(22) Filed: May 25, 2010

(65) Prior Publication Data

US 2011/0102281 A1 May 5, 2011

(30) Foreign Application Priority Data

Oct. 29, 2009 (CN) ..... 2009 1 0210175

(51) Int. Cl.
*H01Q 11/12* (2006.01)

(52) U.S. Cl. ..... 343/742; 343/848; 343/867

(58) Field of Classification Search ..... 343/742, 343/848, 867, 893
See application file for complete search history.

(56) References Cited

U.S. PATENT DOCUMENTS 6,822,618 B2 * 11/2004 Bisiules et al. ..... 343/803
7,471,252 B2 * 12/2008 Onaka et al. ..... 343/702

* cited by examiner

*Primary Examiner* — Tan Ho
(74) *Attorney, Agent, or Firm* — Rabin & Berdo, P.C.

(57) ABSTRACT

A multi-loop antenna module with wide beamwidth includes a grounding unit and a plurality of first loop units and second loop units. The first loop units are vertically disposed on outer peripheral sides of the grounding unit. Each first loop unit has a first shorting pin disposed on the grounding unit, a first feeding pin separated from the first shorting pin and suspended above the grounding unit, and a first loop radiating body connected between the first shorting pin and the first feeding pin. The second loop units are vertically disposed on outer peripheral sides of the grounding unit. Each second loop unit has a second shorting pin disposed on the grounding unit, a second feeding pin separated from the second shorting pin and suspended above the grounding unit, and a second loop radiating body connected between the second shorting pin and the second feeding pin.

20 Claims, 8 Drawing Sheets

MULTI-LOOP ANTENNA MODULE WITH WIDE BEAMWIDTH

BACKGROUND OF THE INVENTION

1. Field of the Invention

The present invention relates to a multi-loop antenna module, in particular, to a multi-loop antenna module with wide beamwidth for providing good RF communications coverage.

2. Description of Related Art

The wireless LAN or 802.11a/b/g/n access-point antenna of the related art is almost of an external antenna structure. Common dipole antennas have a plastic or rubber sleeve covering thereon. In general, the dipole antenna is a single-band antenna for 2.4 GHz operation or a dual-band antenna for 2.4/5 GHz operation. The height of the dipole antenna is triple the thickness of the wireless broadband router/hub device, and one part of the dipole antenna is disposed on a side of the router and the rest of the dipole antenna is protruding from the top of the access-point or router housing. However, the protruded part of the dipole antenna can easily be vandalized by an outside force and also occupies space, which deteriorates the aesthetic appeal of the product, especially for the multi-antenna system.

When 2.4/5 GHz wireless LAN or 802.11a/b/g/n is applied to a dual-band antenna, the antenna has a one RF signal feeding port only. A typical dual-band access-point antenna is a dual-band dipole antenna that comprises two conductive copper tubes and uses a coaxial cable to achieve dual-band 2.4/5 GHz operation. However, the typical dual-band antenna needs a diplexer to simultaneously transmit and/or receive the 2.4 GHz and 5 GHz band signals to a 2.4 GHz module or a 5 GHz module, so that the cost would be increased, and the whole system loses extra gain or power.

Moreover, the related art provides another dual-band cross polarization dipole antenna that discloses a dual-antenna system. The dual-antenna system has two dual-band dipole antennas to generate two frequency bands for 2.4 GHz and 5 GHz operation. However, the antenna structure is of a stack structure, so that the height of the whole antenna structure is high.

Except for the above-mentioned defects, a wireless broadband access-point or router is usually installed on a ceiling, wall or table etc., so that different usage places require different types of antenna radiation patterns. For example, the access-point antenna installed on a ceiling needs to provide conical radiation patterns, the access-point antenna mounted on a wall needs to provide high directional radiation patterns, and the access-point antenna placed on a table needs to provide omnidirectional radiation patterns. However, radiation patterns generated by general antenna can only provide particular coverage, for example, a monopole antenna can only generate omnidirectional radiation patterns along a horizontal direction or conical radiation patterns along an elevation direction, and a patch or microstrip antenna can only provide broadside radiation patterns. That means that a general wireless broadband access-point or router antenna can only be applied to a particular place. In other words, if the access-point antenna is applied to a ceiling, the user cannot take the ceiling-mount access-point antenna for a wall mount access point. It is obvious that the access-point antenna generates different antenna radiation patterns and directions, according to different applications, so that the access-point antenna of the related art, if applied to a wrong place, will generate a communications dead zone to decrease RF signal receiving efficiency and signal transmitting quality.

SUMMARY OF THE INVENTION

In view of the aforementioned issues, the present invention provides a multi-loop antenna module with wide beamwidth. The present invention not only has some advantages such as small size, low profile, good isolation, good radiation properties and extensive application field (for example may be arbitrarily installed on a ceiling, wall or table), but also can replace the external dual-band single-radio access-point antenna of the prior art for 2.4/5 GHz operation with no need of extra diplexers. In addition, the built-in multi-loop antenna module may be hidden in the access-point or router in order to enhance the appearance of the product.

To achieve the above-mentioned objectives, the present invention provides a multi-loop antenna module with wide beamwidth, including: a grounding unit, a plurality of first loop units and a plurality of second loop units. The grounding unit has a plurality of outer peripheral sides. The first loop units are arranged along the outer peripheral sides of the grounding unit and vertically disposed on the grounding unit. Each first loop unit has at least one first shorting pin disposed on the grounding unit, at least one first feeding pin separated from the at least one first shorting pin by a predetermined distance and suspended above the grounding unit at a predetermined distance, and at least one first loop radiating body vertically suspended above the grounding unit at a predetermined distance and connected between the at least one first shorting pin and the at least one first feeding pin. The second loop units are arranged along the outer peripheral sides of the grounding unit and vertically disposed on the grounding unit. The first loop units and the second loop units are alternately and symmetrically arranged. Each second loop unit has at least one second shorting pin disposed on the grounding unit, a second feeding pin separated from the at least one second shorting pin by a predetermined distance and suspended above the grounding unit at a predetermined distance, and at least one second loop radiating body vertically suspended above the grounding unit at a predetermined distance and connected between the at least one second shorting pin and the at least one second feeding pin.

To achieve the above-mentioned objectives, the present invention provides a multi-loop antenna module with wide beamwidth installed in a wireless device housing, including: a grounding unit, a plurality of first loop units and a plurality of second loop units. The grounding unit has a plurality of outer peripheral sides. The first loop units are arranged along the outer peripheral sides of the grounding unit and vertically disposed on the grounding unit. Each first loop unit has at least one first shorting pin disposed on the grounding unit, at least one first feeding pin separated from the at least one first shorting pin by a predetermined distance and suspended above the grounding unit at a predetermined distance, and at least one first loop radiating body vertically suspended above the grounding unit at a predetermined distance and connected between the at least one first shorting pin and the at least one first feeding pin. The second loop units are arranged along the outer peripheral sides of the grounding unit and vertically disposed on the grounding unit. The first loop units and the second loop units are alternately and symmetrically arranged. Each second loop unit has at least one second shorting pin disposed on the grounding unit, a second feeding pin separated from the at least one second shorting pin by a predetermined distance and suspended above the grounding unit at a predetermined distance, and at least one second loop radiating body vertically suspended above the grounding unit at a predetermined distance and connected between the at least one second shorting pin and the at least one second feeding pin. The grounding unit, the first loop units and the second loop units are enclosed by the wireless device housing.

In order to further understand the techniques, means and effects the present invention takes for achieving the prescribed objectives, the following detailed descriptions and appended drawings are hereby referred, such that, through which, the purposes, features and aspects of the present invention may be thoroughly and concretely appreciated; however, the appended drawings are provided solely for reference and illustration, without any intention that they be used for limiting the present invention.

DETAILED DESCRIPTION OF THE PREFERRED EMBODIMENTS

Figure 1A:
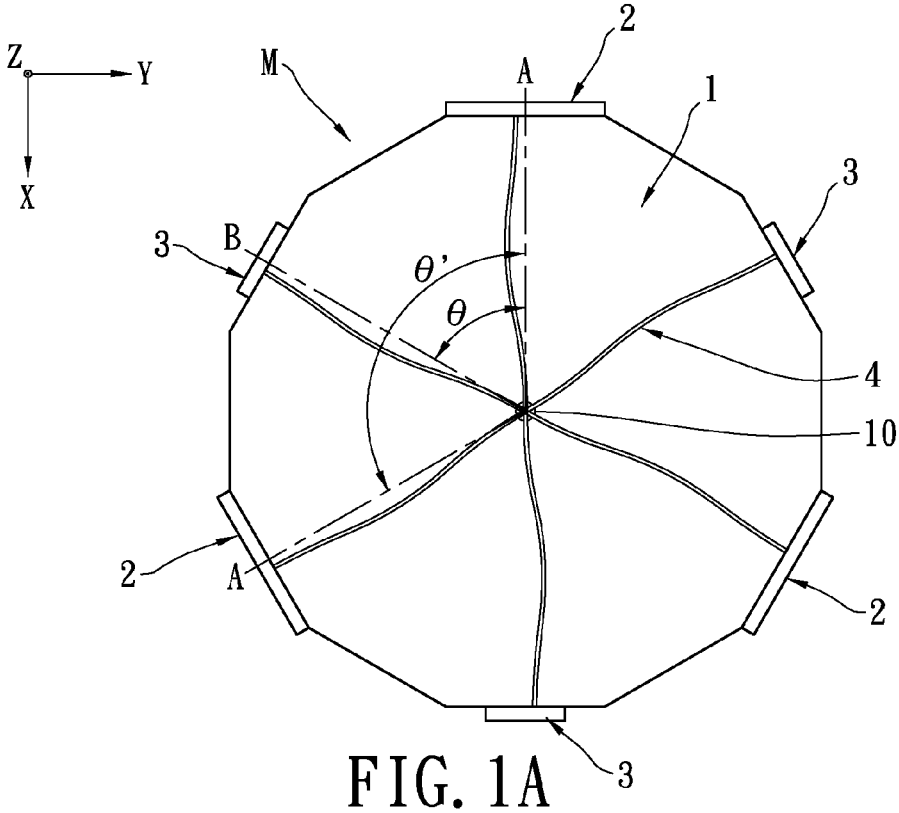
FIG. 1A is a top, schematic view of the multi-loop antenna module with wide beamwidth according to the first embodiment of the present invention.

Referring to 1A to 1D, the first embodiment of the present invention provides a multi-loop antenna module M with wide beamwidth, including: a grounding unit 1, a plurality of first loop units 2 and a plurality of second loop units 3. The first loop units 2 and the second loop units 3 are alternately and symmetrically arranged around a geometric center of the grounding unit 1 and vertically disposed on the grounding unit 1. In addition, the grounding unit 1, the first loop units 2 and the second loop units 3 may be integrally combined to form one-piece metal plate. Of course, the grounding unit 1, the first loop units 2 and the second loop units 3 may be manufactured respectively, and then the finished first loop units 2 and the finished second loop units 3 are disposed on the finished grounding unit 1.

The first loop units 2 and the second loop units 3 are alternately and symmetrically arranged on the grounding unit 1. Each first loop unit 2 has a geometric centerline A (the geometric centerline A connects to the geometric center of the grounding unit 1) and each second loop unit 3 has a geometric centerline B (the geometric centerline B connects to the geometric center of the grounding unit 1), and every two adjacent geometric centerlines (A, B) of the first loop unit 2 and the second loop unit 3 intersect at the geometric center of the grounding unit 1 to form an included angle θ and each of the included angles θ has substantially the same measure. In addition, two geometric centerlines A of every two adjacent first loop units 2 (or every two adjacent second loop units 3) intersect at the geometric center of the grounding unit 1 to form an included angle θ' and each of the included angles θ' has substantially the same measure.

For example, in the embodiment of the present invention, the number of the first loop units 2 is three, the number of the second loop units 3 is three, and each included angle θ between each first loop unit 2 and each second loop unit 3 relative to the geometric center of the grounding unit 1 is 60 degrees, each included angle θ' between the two adjacent first loop units 2 (or the two adjacent second loop units 3) relative to the geometric center of the grounding unit 1 is 120 degrees (as shown in FIG. 1A). However, the above-mentioned number of the first loop units 2 or the second loop units 3 and the above-mentioned included angles θ respectively formed between each first loop unit 2 and each second loop unit 3 or the included angles θ' respectively formed between the two adjacent first loop units 2 (or the two adjacent second loop units 3) are only examples, and these do not limit the present invention.

Moreover, the grounding unit 1 may be a regular polygonal conductive plate, a circular conductive plate or any conductive plates with a predetermined shape (the first embodiment shows the regular polygonal conductive plate as an example), and the grounding unit 1 has a through hole 10 formed on a central portion thereof. In addition, multi-loop antenna module M further includes a plurality of transmission lines 4 passing through the through hole 10, so that the transmission lines 4 may be routed neatly by passing through the through hole 10. Furthermore, RF signals received by the first loop units 2 or the second loop units 3 may be transmitted to wireless device system PCB (not shown) of a router by using the transmission lines 4. Of course, the present invention can omit the through hole 10, so that the transmission lines 4 may be attached to the top surface of the grounding unit 1 in order to facilitate the cable routing for the transmission lines 4.

Figure 1B:
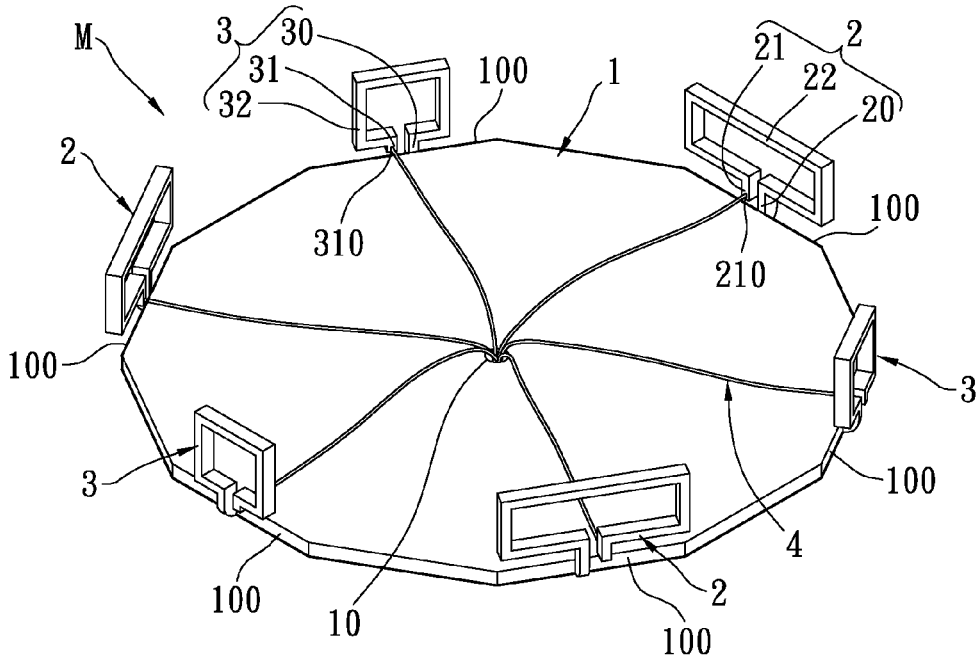
FIG. 1B is a perspective, schematic view of the multi-loop antenna module with wide beamwidth according to the first embodiment of the present invention.
Figure 1C:
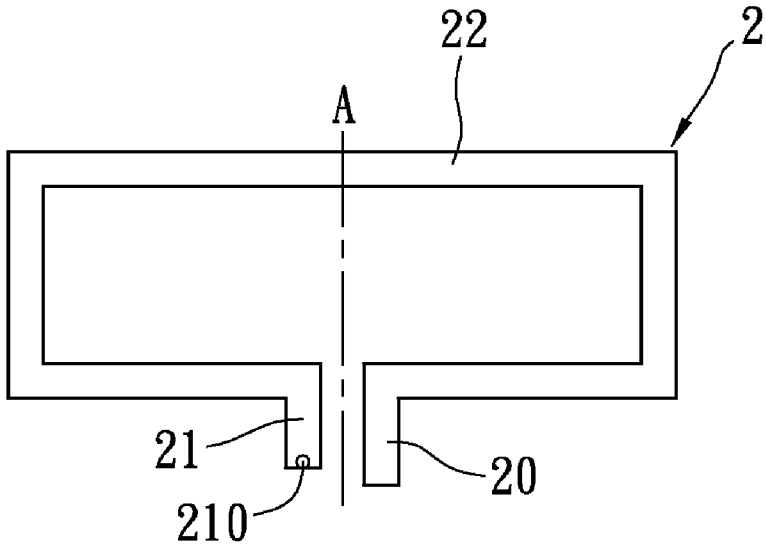
FIG. 1C is a front, schematic view of one first loop unit according to the first embodiment of the present invention.

Referring to FIGS. 1B and 1C, the grounding unit 1 has a plurality of outer peripheral sides 100. The first loop units 2 are arranged along the outer peripheral sides 100 of the grounding unit 1 and vertically disposed on the grounding unit 1. Each first loop unit 2 has at least one first shorting pin 20 disposed on the grounding unit 1, at least one first feeding pin 21 separated from the at least one first shorting pin 20 by a predetermined distance and suspended above the grounding unit 1 at a predetermined distance, and at least one first loop radiating body 22 vertically suspended above the grounding unit 1 at a predetermined distance and connected between the at least one first shorting pin 20 and the at least one first feeding pin 21. Referring to FIG. 1C, the first shorting pin 20 and the first feeding pin 21 of each first loop unit 2 are symmetrically disposed beside two sides (left direction and right direction) of the geometric centerline A of each first loop unit 2.

Figure 1D:
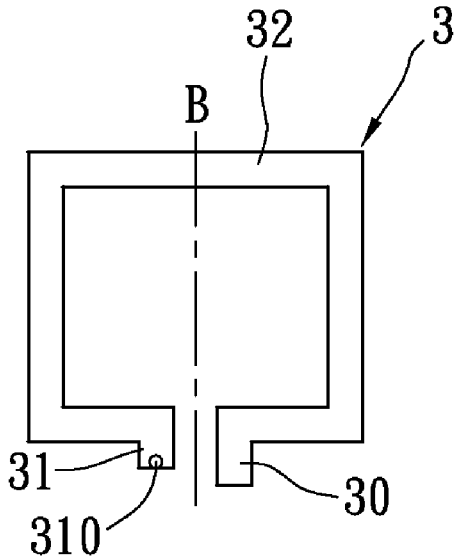
FIG. 1D is a front, schematic view of one second loop unit according to the first embodiment of the present invention.
Figure 1E:
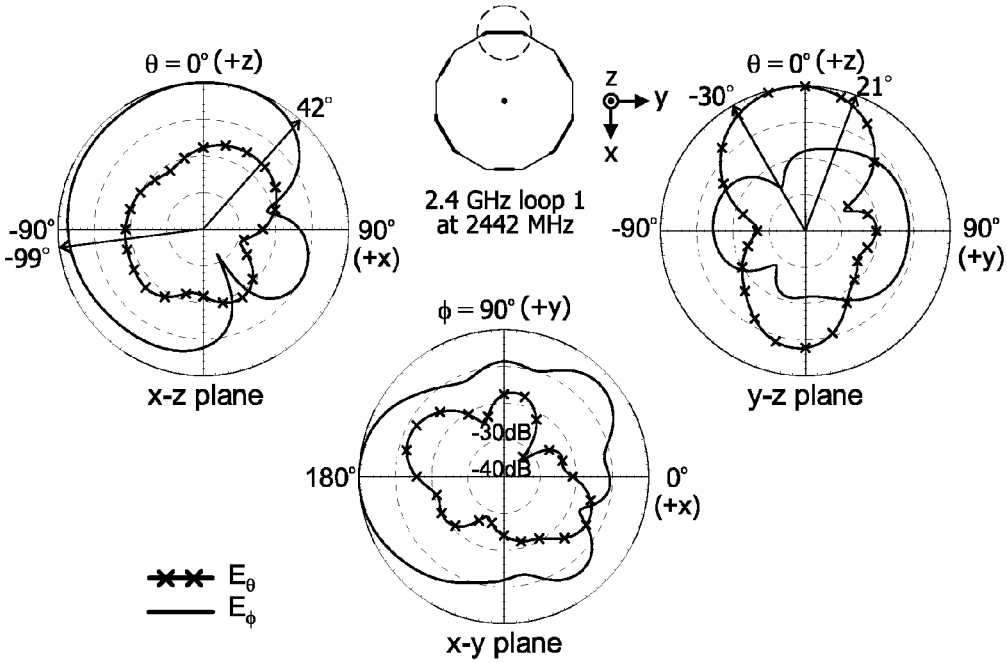
FIG. 1E shows radiation patterns of one first loop unit at 2442 MHz in different planes (such as x-z plane, y-z plane and x-y plane) according to the first embodiment of the present invention.

Referring to FIGS. 1A and 1E, FIG. 1E shows measurement results of radiation patterns of one first loop unit 2 (the topmost first loop unit 2 in FIG. 1A) at 2442 MHz in different planes (such as x-z plane, y-z plane and x-y plane) according to the definition of the coordinate in FIG. 1A.

Referring to FIG. 1E, each first loop unit 2 is a one-wavelength loop and a balanced structure that can restrain excited currents generated on the surface of the grounding unit 1. Therefore, the present invention can take the grounding unit 1 as a good reflecting plate (as a reflector), so that the antenna radiation patterns of the first loop unit 2 show high directivity especially along +z and −x directions for high antenna-gain properties.

Referring to FIG. 1E, the first loop units 2 are vertically disposed on the edge (such as the outer peripheral sides 100) of the grounding unit 1. Because the antenna radiation patterns are reflected by the grounding unit 1 along two orthogonal directions (one direction is vertical to the grounding unit 1 and horizontal to the first loop units 2, and the other direction is horizontal to the grounding unit 1), 3 dB half-power beamwidth of each first loop unit 2 on x-z plane as shown in FIG. 1E can cover an angle that is more than at least one quadrant on the polar coordinate. For example, 3 dB half-power beamwidth of each first loop unit 2 (loop 1) at 2.4 GHz on x-z plane as shown in FIG. 1E is about 141 degrees. Hence, each first loop unit 2 has wide beamwidth radiation patterns. In other words, the three independent first loop units 2 are incorporated to generate radiation patterns that can cover one half plane space and have the same antenna gain or power. Therefore, when the multi-loop antenna module M is installed in the wireless broadband access-point or router, the wireless broadband access-point or router can be applied to different places such as a ceiling, wall or table etc.

Referring to FIGS. 1B and 1D, the second loop units 3 are arranged along the outer peripheral sides 100 of the grounding unit 1 and vertically disposed on the grounding unit 1. Each second loop unit 3 has at least one second shorting pin 30 disposed on the grounding unit 1, at least one second feeding pin 31 separated from the at least one second shorting pin 30 by a predetermined distance and suspended above the grounding unit 1 at a predetermined distance, and at least one second loop radiating body 32 vertically suspended above the grounding unit 1 at a predetermined distance and connected between the at least one second shorting pin 30 and the at least one second feeding pin 31. Referring to FIG. 1D, the second shorting pin 30 and the second feeding pin 31 of each second loop unit 3 are symmetrically disposed beside two sides (left direction and right direction) of the geometric centerline B of each second loop unit 3.

Figure 1F:
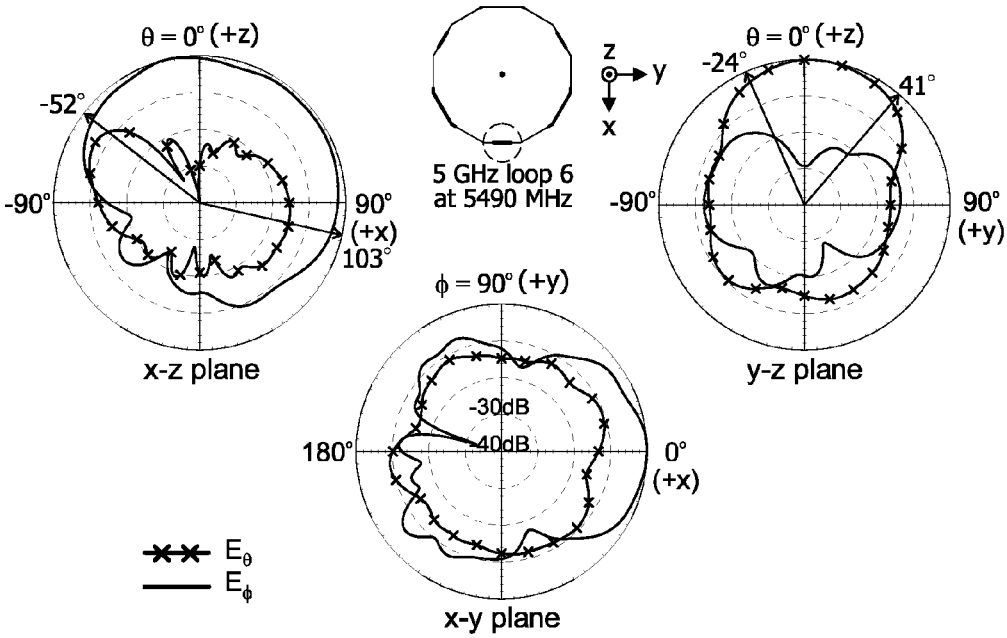
FIG. 1F shows radiation patterns of one second loop unit at 5490 MHz in different planes (such as x-z plane, y-z plane and x-y plane) according to the first embodiment of the present invention.

Referring to FIGS. 1A and 1F, FIG. 1F shows measurement results of radiation patterns of one second loop unit 3 (the bottommost second loop unit 3 in FIG. 1A) at 5490 MHz in different planes (such as x-z plane, y-z plane and x-y plane) according to the definition of the coordinate in FIG. 1A.

Referring to FIG. 1F, each second loop unit 3 is a one-wavelength loop and a balanced structure that can restrain excited currents generated on the surface of the grounding unit 1. Therefore, the present invention can take the grounding unit 1 as a reflecting plate, so that the antenna radiation patterns of the second loop unit 3 show high directivity especially along +z and −x directions for high antenna-gain properties.

Referring to FIG. 1F, the second loop units 3 are vertically disposed on the edge (such as the outer peripheral sides 100) of the grounding unit 1. Because the antenna radiation patterns are reflected by the grounding unit 1 along two orthogonal directions (one direction is vertical to the grounding unit 1 and horizontal to the second loop units 3, and the other direction is horizontal to the grounding unit 1), 3 dB half-power beamwidth of each second loop unit 3 on x-z plane as shown in FIG. 1F can cover an angle that is more than at least one quadrant on the polar coordinate. For example, 3 dB half-power beamwidth of each second loop unit 3 (loop 6) at 5 GHz on x-z plane as shown in FIG. 1F is about 155 degrees. Hence, each second loop unit 3 has wide beamwidth radiation patterns. In other words, the three independent second loop units 3 are incorporated to generate radiation patterns that can cover one half plane space and have the same antenna gain or power. Therefore, when the multi-loop antenna module M is installed in the wireless broadband access-point or router, the wireless broadband access-point or router can be applied to different places such as a ceiling, wall or table etc.

Furthermore, the first loop unit 2 and the second loop unit 3 have some different design aspects, as follows:

1. Referring to FIG. 1B, the first feeding pin 21 of each first loop unit 2 is adjacent to the second shorting pin 30 of one adjacent second loop unit 3, and the first shorting pin 20 of each first loop unit 2 is adjacent to the second feeding pin 31 of another adjacent second loop unit 3.

In other words, looking at any one first loop unit 2, the first feeding pin 21 of the first loop unit 2 is adjacent to the second shorting pin 30 of the second loop unit 3 that is disposed beside the left side of the first loop unit 2, and the first shorting pin 20 of the first loop unit 2 is adjacent to the second feeding pin 31 of the second loop unit 3 that is disposed beside the right side of the first loop unit 2. The above-mentioned alternate-antenna design can prevent the first feeding pins 21 and the second feeding pins 31 from being highly coupled with each other.

Therefore, the mutual coupling between each first loop unit 2 with first antenna operating frequencies (first frequency band) and each second loop unit 3 with second antenna operating frequencies (second frequency band) is substantially decreased and the isolation can be remained under at least −15 dB.

2. Referring to FIGS. 1C and 1D, the first shorting pin 20 and the first feeding pin 21 of each first loop unit 2 are separated from each other by a predetermined distance, and the second shorting pin 30 and the second feeding pin 31 of each second loop unit 3 are separated from each other by a predetermined distance, in order to obtain good impedance matching. In addition, a designer can adjust the above-mentioned predetermined distances in order to change antenna operating frequencies according to different design requirements. In other words, the predetermined distance between the first shorting pin 20 and the first feeding pin 21 of each first loop unit 2 and the predetermined distance between the second shorting pin 30 and the second feeding pin 31 of each second loop unit 3 may be adjusted according to different antenna performance that a designer wants. In addition, the heights of each first loop unit 2 and each second loop unit 3 relative to the grounding unit 1 also may be adjusted according to different antenna performance that a designer wants.

Therefore, the multi-loop antenna module M of the present invention can obtain good impedance matching (defined by 2:1 VSWR or 10 dB return loss) for WLAN operation in the 2.4 GHz and 5 GHz bands by adjusting (1) the distance between the first shorting pin 20 and the first feeding pin 21 of each first loop unit 2, (2) the distance between the second shorting pin 30 and the second feeding pin 31 of each second loop unit 3, and (3) the height of each first loop unit 2 and the height of each second loop unit 3 relative to the grounding unit 1.

3. Referring to FIGS. 1B and 1D, each first feeding pin 21 has a first feeding point 210 on a bottom portion thereof, and each second feeding pin 31 has a second feeding point 310 on a bottom portion thereof. The first feeding points 210 and the second feeding points 310 face the geometric center of the grounding unit 1. In addition, the distance between each first feeding point 210 and the geometric center of the grounding unit 1 may be different from the distance between each second feeding point 310 and the geometric center of the grounding unit 1, but the distance between any one of feeding points with the same operating frequencies and the geometric center of the grounding unit 1 is the same.

Moreover, the transmission lines 4 are respectively connected to the first feeding points 210 of the first feeding pins 21 and the second feeding points 310 of the second feeding pins 31. Hence, RF signals received by the first loop units 2 or the second loop units 3 may be transmitted to PCB of a wireless device system or a router by using the transmission lines 4.

4. Referring to FIGS. 1A and 1B, the first shorting pin 20, the first feeding pin 21 and the first loop radiating body 22 of each first loop unit 2 are formed on the same plane or curved surface, and the second shorting pin 30, the second feeding pin 31 and the second loop radiating body 32 of each second loop unit 3 are formed on the same plane or curved surface.

5. The antenna operating frequencies of the first loop units 2 are the same (such as antenna lower band), and the antenna operating frequencies of the second loop units 3 are the same (such as antenna upper band). For example, the antenna operating frequencies of each first loop unit 2 may be in the 2.4 GHz band, and the antenna operating frequencies of each second loop unit 3 may be in the 5 GHz band.

Furthermore, the structures of the first loop units 2 and the second loop units 3 in the above-mentioned five different design aspects are an example in the present invention. FIG. 1A shows three first loop units 2, the topmost one of the three first loop units 2 is defined as a first one of the three first loop units 2, another first loop unit 2 disposed at the lower left-hand corner is defined as a second one of the three first loop units 2, and the other first loop unit 2 disposed at the lower right-hand corner is defined as a third one of the three first loop units 2. FIG. 1A shows three second loop units 3, one second loop unit 3 disposed at the upper right-hand corner is defined as a first one of the three second loop units 3, another second loop unit 3 disposed at the upper left-hand corner is defined as a second one of the three second loop units 3, and the bottommost one of the three second loop units 3 is defined as a third one of the three second loop units 3.

Figure 1G:
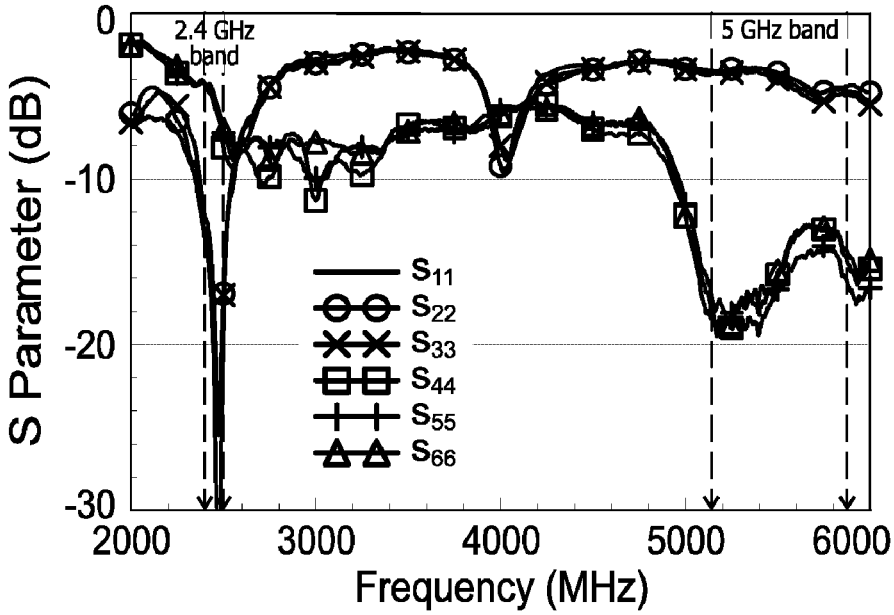
FIG. 1G is a curve diagram of the reflection coefficients (S parameters (dB)) of three first loop units and three second loop units against frequencies (MHz) according to the first embodiment of the present invention.

Referring to FIGS. 1A and 1G, FIG. 1G shows reflection coefficients (S parameters (dB)) of the first loop units 2 (such as curves of $S_{11}$, $S_{22}$ and $S_{33}$) and the second loop units 3 (such as curves of $S_{44}$, $S_{55}$ and $S_{66}$) against frequencies (MHz) according to the test results of the first loop units 2 and the second loop units 3. The reflection coefficients in the 2.4 GHz and 5 GHz ands are under −10 dB as shown in FIG. 1G.

Figure 1H:
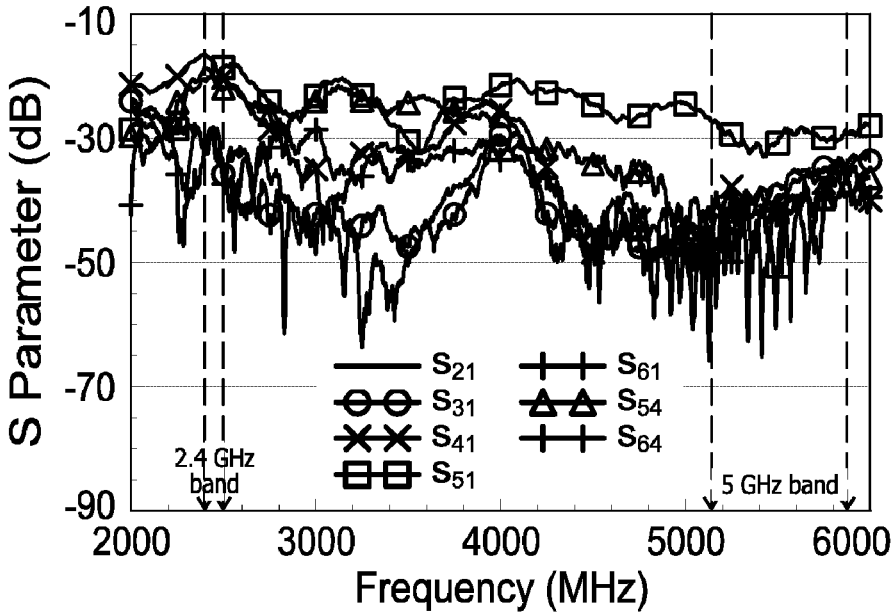
FIG. 1H is a curve diagram (only showing seven curves) of the isolation (S parameters (dB)) between any two loop units among the first loop units and the second loop units against frequencies (MHz) according to the first embodiment of the present invention.

Referring to FIGS. 1A and 1H, FIG. 1H shows the isolation (S parameters (dB)) between any two loop units among the first loop units 2 and the second loop units 3 against frequencies (MHz) according to the test results of the first loop units 2 and the second loop units 3. In FIG. 1H, it is only presented by the curves of $S_{21}$, $S_{31}$, $S_{41}$, $S_{51}$, $S_{61}$, $S_{54}$ and $S_{64}$. In addition, $S_{21}$ means the isolation between second one and first one of the first loop units 2, $S_{31}$ means the isolation between third one and first one of the first loop units 2, $S_{41}$ means the isolation between first one of the second loop units 3 and first one of the first loop units 2, $S_{51}$ means the isolation between second one of the second loop units 3 and first one of the first loop units 2, $S_{61}$ means the isolation between third one of the second loop units 3 and first one of the first loop units 2, $S_{54}$ means the isolation between second one and first one of the second loop units 3, and $S_{64}$ means the isolation between third one and first one of the second loop units 3. The isolation in the 2.4 GHz and 5 GHz bands can be remained under −15 dB as shown in FIG. 1H.

Figure 1I:
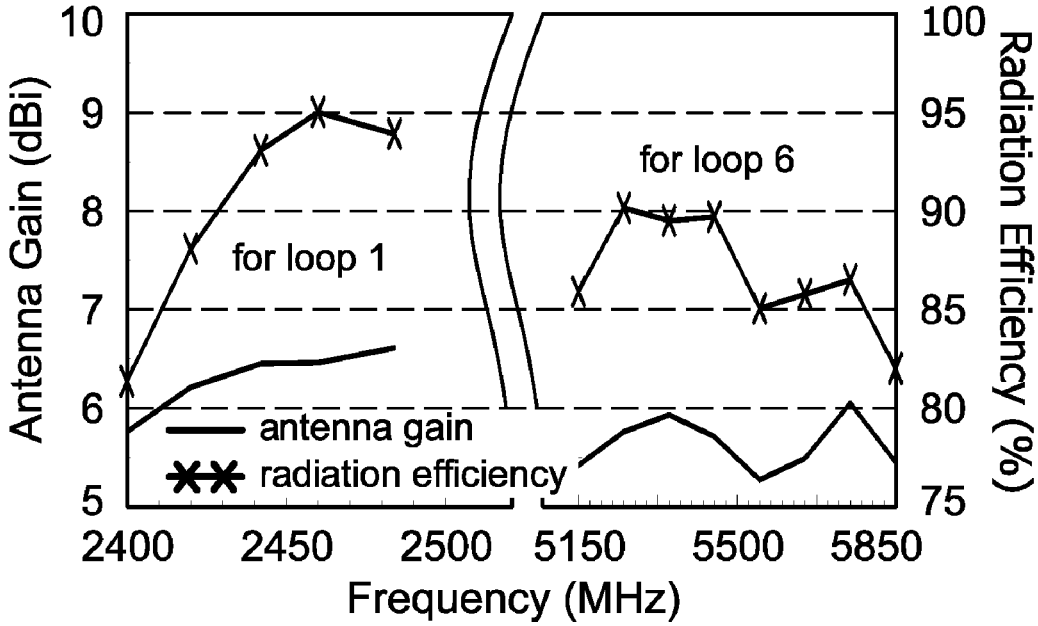
FIG. 1I is a curve diagram of the antenna peak gain (dBi) and the radiation efficiency (%) of one of the first loop units and one of the second loop units against frequencies (MHz) according to the first embodiment of the present invention.

Referring to FIGS. 1A and 1I, FIG. 1I shows antenna peak gain (dBi) and radiation efficiency (%) of first one of the first loop units 2 (loop 1) and third one of the second loop units 3 (loop 6) against frequencies (MHz) according to the test results of the first loop units 2 and the second loop units 3. When the antenna gain of the first loop unit 2 is 6.5 dB nearby and the antenna gain of the second loop unit 3 is 5.5 dB nearby, the radiation efficiency of the first loop unit 2 or the second loop unit 3 is over 80%.

Figure 1J:
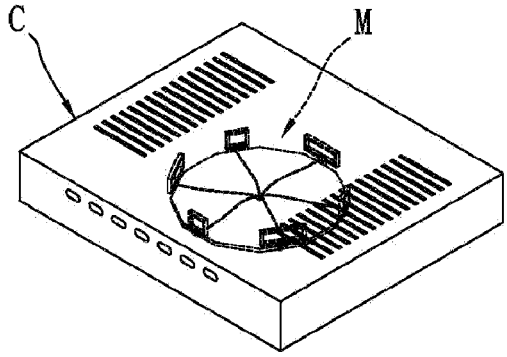
FIG. 1J is a perspective, schematic view of the multi-loop antenna module with wide beamwidth installed in a wireless device housing according to the first embodiment of the present invention.
Figure 2A:
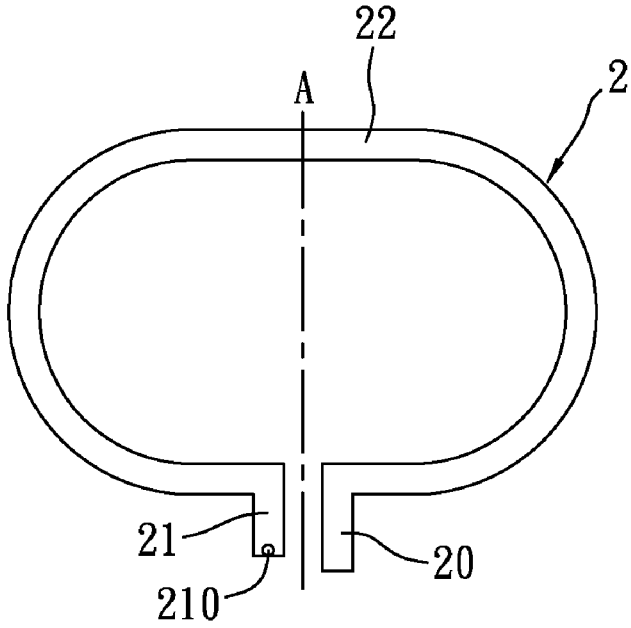
FIG. 2A is a front, schematic view of one first loop unit according to the second embodiment of the present invention.
Figure 2B:
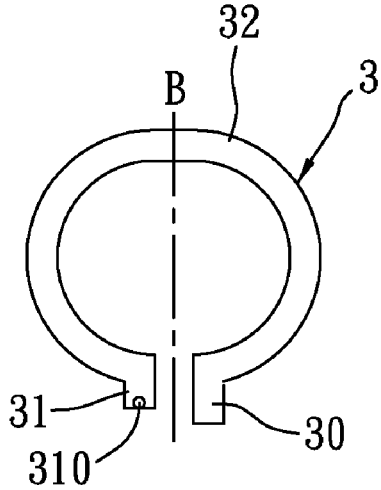
FIG. 2B is a front, schematic view of one second loop unit according to the second embodiment of the present invention.
Figure 3A:
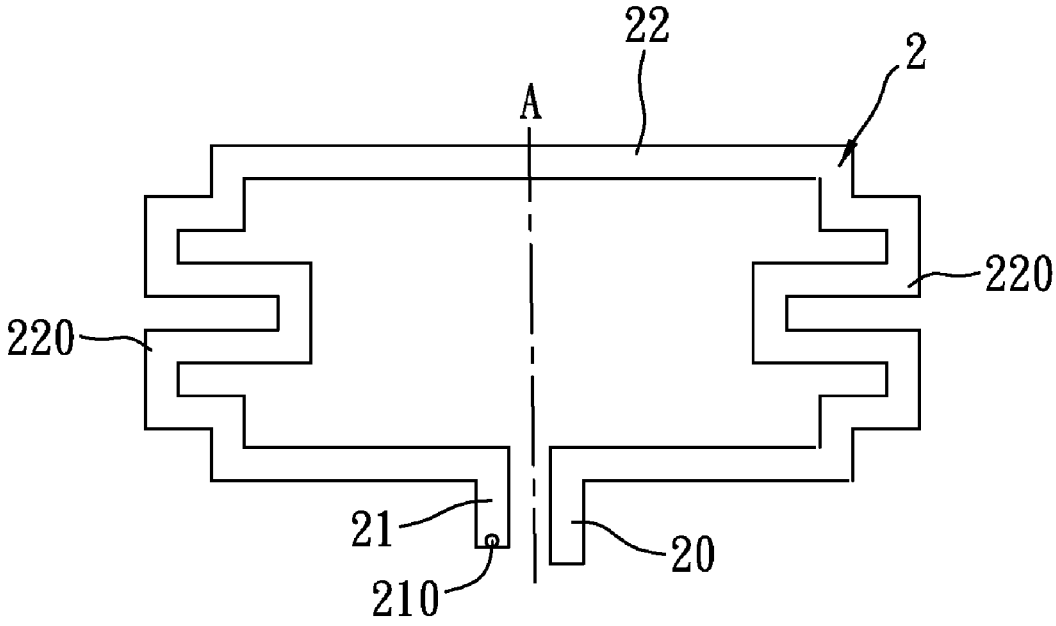
FIG. 3A is a front, schematic view of one first loop unit according to the third embodiment of the present invention.
Figure 3B:
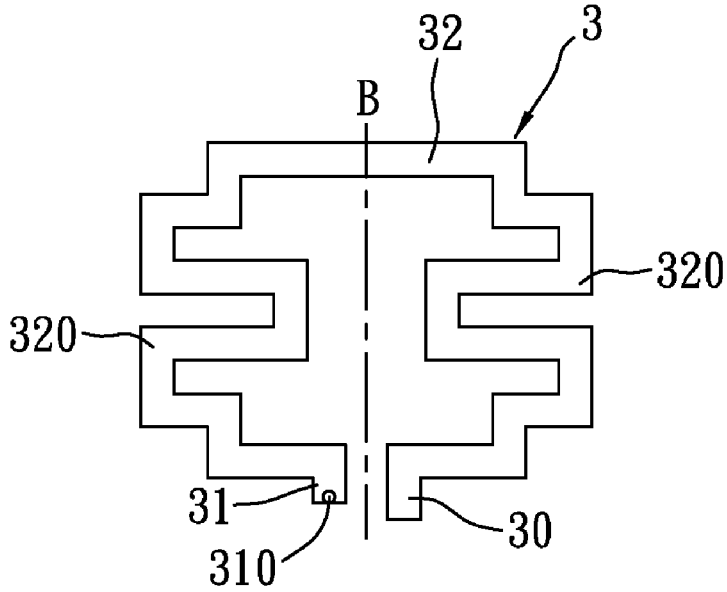
FIG. 3B is a front, schematic view of one second loop unit according to the third embodiment of the present invention.
Figure 4A:
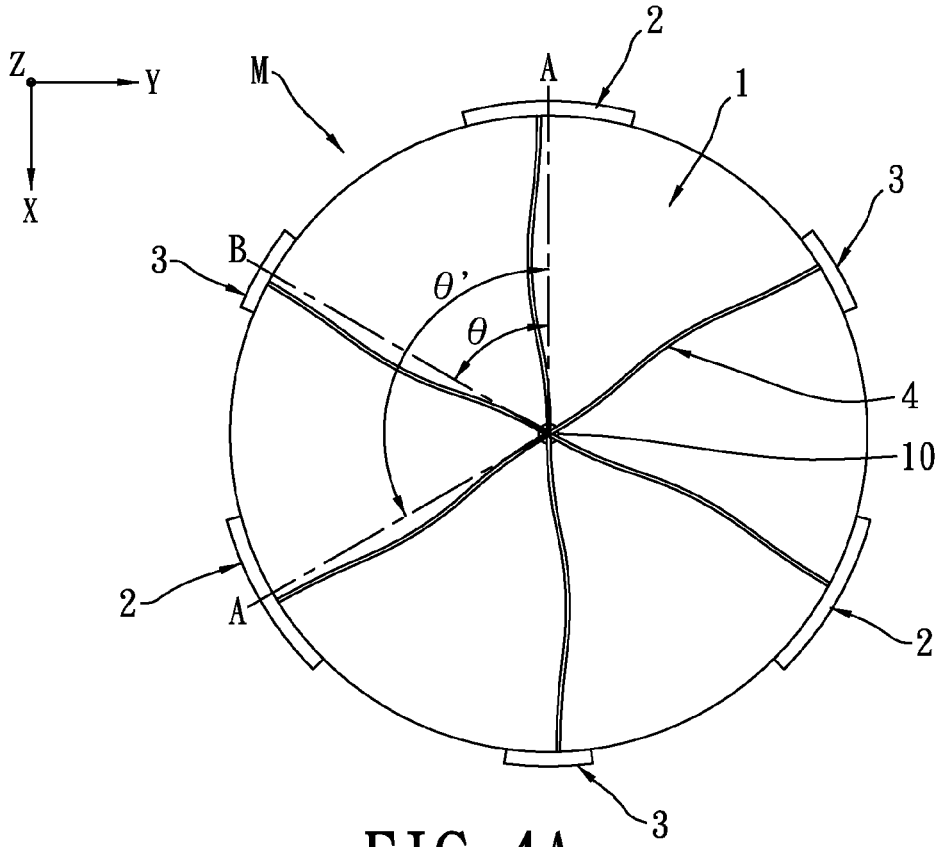
FIG. 4A is a top, schematic view of the multi-loop antenna module with wide beamwidth according to the fourth embodiment of the present invention.
Figure 4B:
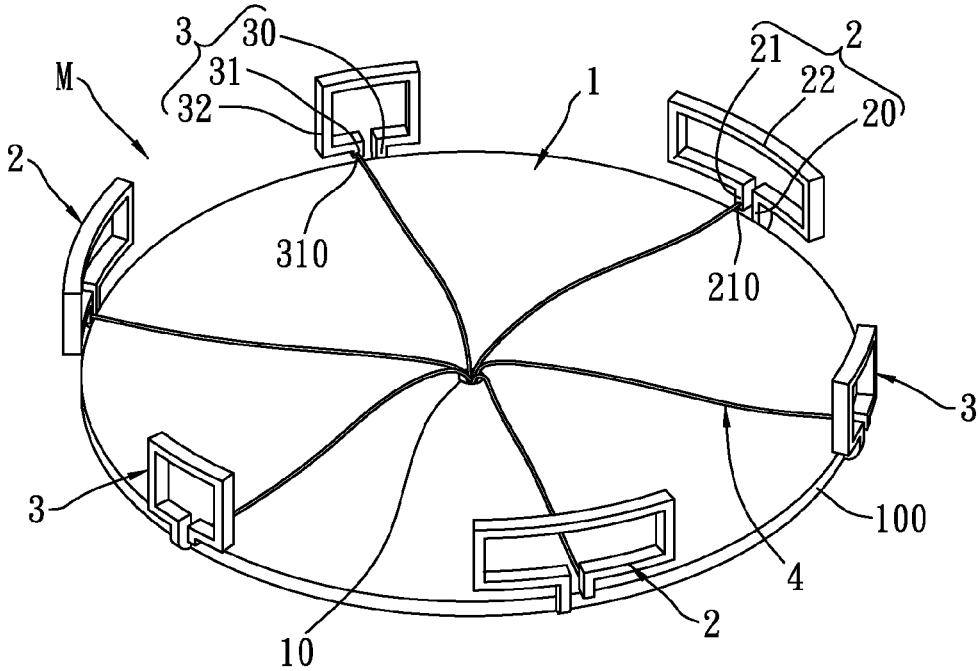
FIG. 4B is a perspective, schematic view of the multi-loop antenna module with wide beamwidth according to the fourth embodiment of the present invention.

Referring to FIG. 1J, the multi-loop antenna module M of the present invention may be installed in a wireless device housing C (such as the housing of an access point or router or hub), for example, the multi-loop antenna module M may be installed on the internal side of a top cover of the wireless device housing C. In other words, the grounding unit 1, the first loop units 2 and the second loop units 3 are enclosed by the wireless device housing C. Hence, the multi-loop antenna module M may be hidden in the wireless device without need to be placed outside the wireless device housing C in order to enhance the appearance of the product that uses multi-loop antenna module M.

Referring to 2A to 2B, the second embodiment of the present invention provides a multi-loop antenna module M with wide beamwidth, including: a grounding unit 1, a plurality of first loop units 2 and a plurality of second loop units 3. The difference between the second embodiment and the first embodiment is that: in the second embodiment, the first loop radiating body 22 of each first loop unit 2 is an arc-shaped body connected between each corresponding first shorting pin 20 and each corresponding first feeding pin 21, and the second loop radiating body 32 of each second loop unit 3 is an arc-shaped body connected between each corresponding second shorting pin 30 and each corresponding second feeding pin 31. Of course, the function and the effect generated by the multi-loop antenna module M of the second embodiment are the same as the multi-loop antenna module M of the first embodiment.

Referring to 3A to 3B, the third embodiment of the present invention provides a multi-loop antenna module M with wide beamwidth, including: a grounding unit 1, a plurality of first loop units 2 and a plurality of second loop units 3. The difference between the third embodiment and the first embodiment is that: in the third embodiment, the first loop radiating body 22 of each first loop unit 2 has two symmetrical first curved portions 220, and the second loop radiating body 32 of each second loop unit 3 has two symmetrical second curved portions 320. In addition, when the length of loop radiating body is increased, the resonant path is also increased in order to decrease antenna operating frequencies and size of the multi-loop antenna module M. Of course, the function and the effect generated by the multi-loop antenna module M of the third embodiment are the same as the multi-loop antenna module M of the first embodiment.

Referring to 4A to 4B, the fourth embodiment of the present invention provides a multi-loop antenna module M with wide beamwidth, including: a grounding unit 1, a plurality of first loop units 2 and a plurality of second loop units 3. The difference between the fourth embodiment and the first embodiment is that: in the fourth embodiment, the first shorting pin 20, the first feeding pin 21 and the first loop radiating body 22 of each first loop unit 2 are formed on the same curved surface and disposed on or along the outer peripheral side 100 of the grounding unit 1, and the second shorting pin 30, the second feeding pin 31 and the second loop radiating body 32 of each second loop unit 3 are formed on the same curved surface 100 of the grounding unit 1. The width of each first loop radiating body 22 or each second loop radiating body 32 is increased in the fourth embodiment in order to increase resonant path without adding the whole size of the multi-loop antenna module M. Of course, the function and the effect generated by the multi-loop antenna module M of the fourth embodiment are the same as the multi-loop antenna module M of the first embodiment.

In conclusion, the present invention has the following advantages:

1. In the above-mentioned examples, the present invention uses three independent first loop units for 2.4 GHz operation and three independent second loop units for 5 GHz operation in order to achieve concurrent dual-band operation. Hence, the present invention is different from the dual-band single-radio antenna of the related art. For example, the dual-band single-radio antenna of the related art has a one RF signal feeding port only, so that the dual-band single-radio antenna of the related art needs to use an extra diplexer to achieve concurrent dual-band dual-radio operation. Therefore, for the dual-band single-radio antenna of the related art, the cost would be increased and the whole system loses extra gain or power.

2. In the above-mentioned examples, the whole height of the multi-loop antenna module with wide beamwidth of the present invention does not exceed 15 mm in order to achieve the purpose of manufacturing built-in multi-antenna system. In other words, the built-in multi-loop antenna module may be hidden in the access point or router in order to enhance the appearance of the product.

3. The multi-loop antenna module with wide beamwidth of the present invention can obtain good impedance matching (defined by 2:1 VSWR or 10 dB return loss) for WLAN operation in the 2.4 GHz and 5 GHz bands by adjusting (1) the distance between the first shorting pin and the first feeding pin of each first loop unit, (2) the distance between the second shorting pin and the second feeding pin of each second loop unit, and (3) the height of each first loop unit and the height of each second loop unit relative to the grounding unit.

4. Because the first shorting pin of each first loop unit is adjacent to the second feeding pin of each second loop unit (or the second shorting pin of each second loop unit is adjacent to the first feeding pin of each first loop unit), the mutual coupling between each first loop unit with first antenna operating frequencies and each second loop unit with second antenna operating frequencies is substantially decreased and the isolation can be remained under at least −15 dB.

5. In the above-mentioned examples, each first loop unit and each second loop unit may be of a one-wavelength loop structure, which is a balanced structure that can substantially mitigate the surface currents excited on the surface of the antenna grounding plate or system ground plane. Therefore, the grounding plate such as the grounding unit of the present invention may act as a reflector, so that the directivity of the antenna radiation is large to obtain high antenna gain.

6. In the above-mentioned examples, the first loop units and the second loop units are vertically disposed on the edge (such as the outer peripheral sides) of the grounding unit. Because the antenna radiation patterns are reflected by the grounding unit along two orthogonal directions (one direction is vertical to the grounding unit and horizontal to the first loop units and the second loop units, and the other direction is horizontal to the grounding unit), 3 dB half-power beamwidth of each first loop unit and each second loop unit on x-z plane can cover an angle that is more than at least one quadrant on the polar coordinate. For example, 3 dB half-power beamwidth of each first loop unit at 2.4 GHz on x-z plane is about 141 degrees, and 3 dB half-power beamwidth of each second loop unit at 5 GHz on x-z plane is about 155 degrees. Hence, each first loop unit and each second loop unit both have wide beamwidth radiation patterns.

7. When the three independent first loop units operate at 2.4 GHz together or the three independent second loop units operate at 5 GHz together, the three independent first loop units or the three independent second loop units are incorporated to generate radiation patterns that can cover one half plane space and have the antenna gain or power within 3 dB variation. Therefore, when the multi-loop antenna module is installed in the wireless broadband access point or router, the wireless broadband access point or router can be applied to different places such as a ceiling, wall or table etc.

8. The multi-loop antenna module of the present invention may be made of one-piece metal conductive plate by stamping or line-cutting. In other words, the multi-loop antenna module can be formed by a single metal plate. Hence, the present invention can effectively decrease manufacturing cost and time.

The above-mentioned descriptions merely represent solely the preferred embodiments of the present invention, without any intention or ability to limit the scope of the present invention which is fully described only within the following claims. Various equivalent changes, alterations or modifications based on the claims of present invention are all, consequently, viewed as being embraced by the scope of the present invention.

What is claimed is:

1. A multi-loop antenna module with wide beamwidth, comprising:

a grounding unit having a plurality of outer peripheral sides;

a plurality of first loop units arranged along the outer peripheral sides of the grounding unit and vertically disposed on the grounding unit, wherein each first loop unit has at least one first shorting pin disposed on the grounding unit, at least one first feeding pin separated from the at least one first shorting pin by a predetermined distance and suspended above the grounding unit at a predetermined distance, and at least one first loop radiating body vertically suspended above the grounding unit at a predetermined distance and connected between the at least one first shorting pin and the at least one first feeding pin; and a plurality of second loop units arranged along the outer peripheral sides of the grounding unit and vertically disposed on the grounding unit, wherein the first loop units and the second loop units are alternately and symmetrically arranged, and each second loop unit has at least one second shorting pin disposed on the grounding unit, a second feeding pin separated from the at least one second shorting pin by a predetermined distance and suspended above the grounding unit at a predetermined distance, and at least one second loop radiating body vertically suspended above the grounding unit at a predetermined distance and connected between the at least one second shorting pin and the at least one second feeding pin.

2. The multi-loop antenna module according to claim 1, further comprising a plurality of transmission lines corresponding to the first loop units and the second loop units, and the transmission lines respectively connected to the first feeding pins and the second feeding pins, wherein the grounding unit has a through hole formed on a central portion thereof, and the transmission lines pass through the through hole.

3. The multi-loop antenna module according to claim 1, wherein each first loop unit has a geometric centerline and each second loop unit has a geometric centerline, and every two adjacent geometric centerlines of the first loop unit and the second loop unit intersect at a geometric center of the grounding unit to form an included angle and each of the included angles has substantially the same measure.

4. The multi-loop antenna module according to claim 3, wherein the first shorting pin and the first feeding pin of each first loop unit are symmetrically disposed beside two sides of the geometric centerline of each first loop unit, and the second shorting pin and the second feeding pin of each second loop unit are symmetrically disposed beside two sides of the geometric centerline of each second loop unit.

5. The multi-loop antenna module according to claim 1, wherein the first feeding pin of each first loop unit is adjacent to the second shorting pin of one adjacent second loop unit, and the first shorting pin of each first loop unit is adjacent to the second feeding pin of another adjacent second loop unit.

6. The multi-loop antenna module according to claim 1, wherein the first shorting pin, the first feeding pin and the first loop radiating body of each first loop unit are formed on the same plane or curved surface, and the second shorting pin, the second feeding pin and the second loop radiating body of each second loop unit are formed on the same plane or curved surface.

7. The multi-loop antenna module according to claim 1, wherein the first loop units operates in a first frequency band and the second loop units operates in a second frequency band.

8. The multi-loop antenna module according to claim 1, wherein the grounding unit, the first loop units and the second loop units are integrally combined to form one-piece metal plate.

9. The multi-loop antenna module according to claim 1, wherein the first loop radiating body of each first loop unit is an arc-shaped body connected between each corresponding first shorting pin and each corresponding first feeding pin, and the second loop radiating body of each second loop unit is an arc-shaped body connected between each corresponding second shorting pin and each corresponding second feeding pin.

10. The multi-loop antenna module according to claim 1, wherein the first loop radiating body of each first loop unit has two symmetrical first curved portions, and the second loop radiating body of each second loop unit has two symmetrical second curved portions.

11. A multi-loop antenna module with wide beamwidth installed in a wireless device housing, comprising:

a grounding unit having a plurality of outer peripheral sides;

a plurality of first loop units arranged along the outer peripheral sides of the grounding unit and vertically disposed on the grounding unit, wherein each first loop unit has at least one first shorting pin disposed on the grounding unit, at least one first feeding pin separated from the at least one first shorting pin by a predetermined distance and suspended above the grounding unit at a predetermined distance, and at least one first loop radiating body vertically suspended above the grounding unit at a predetermined distance and connected between the at least one first shorting pin and the at least one first feeding pin; and a plurality of second loop units arranged along the outer peripheral sides of the grounding unit and vertically disposed on the grounding unit, wherein the first loop units and the second loop units are alternately and symmetrically arranged, and each second loop unit has at least one second shorting pin disposed on the grounding unit, a second feeding pin separated from the at least one second shorting pin by a predetermined distance and suspended above the grounding unit at a predetermined distance, and at least one second loop radiating body vertically suspended above the grounding unit at a predetermined distance and connected between the at least one second shorting pin and the at least one second feeding pin;

wherein the grounding unit, the first loop units and the second loop units are enclosed by the wireless device housing.

12. The multi-loop antenna module according to claim 11, further comprising a plurality of transmission lines corresponding to the first loop units and the second loop units, and the transmission lines respectively connected to the first feeding pins and the second feeding pins, wherein the grounding unit has a through hole formed on a central portion thereof, and the transmission lines pass through the through hole.

13. The multi-loop antenna module according to claim 11, wherein each first loop unit has a geometric centerline and each second loop unit has a geometric centerline, and every two adjacent geometric centerlines of the first loop unit and the second loop unit intersect at a geometric center of the grounding unit to form an included angle and each of the included angles has substantially the same measure.

14. The multi-loop antenna module according to claim 13, wherein the first shorting pin and the first feeding pin of each first loop unit are symmetrically disposed beside two sides of the geometric centerline of each first loop unit, and the second shorting pin and the second feeding pin of each second loop unit are symmetrically disposed beside two sides of the geometric centerline of each second loop unit.

15. The multi-loop antenna module according to claim 11, wherein the first feeding pin of each first loop unit is adjacent to the second shorting pin of one adjacent second loop unit, and the first shorting pin of each first loop unit is adjacent to the second feeding pin of another adjacent second loop unit.

16. The multi-loop antenna module according to claim 11, wherein the first shorting pin, the first feeding pin and the first loop radiating body of each first loop unit are formed on the same plane or curved surface, and the second shorting pin, the second feeding pin and the second loop radiating body of each second loop unit are formed on the same plane or curved surface.

17. The multi-loop antenna module according to claim 11, wherein the first loop units operates in a first frequency band and the second loop units operates in a second frequency band.

18. The multi-loop antenna module according to claim 11, wherein the grounding unit, the first loop units and the second loop units are integrally combined to form one-piece metal plate.

19. The multi-loop antenna module according to claim 11, wherein the first loop radiating body of each first loop unit is an arc-shaped body connected between each corresponding first shorting pin and each corresponding first feeding pin, and the second loop radiating body of each second loop unit is an arc-shaped body connected between each corresponding second shorting pin and each corresponding second feeding pin.

20. The multi-loop antenna module according to claim 11, wherein the first loop radiating body of each first loop unit has two symmetrical first curved portions, and the second loop radiating body of each second loop unit has two symmetrical second curved portions.

* * * * *